United States Patent [19]

Foose et al.

[11] 4,300,075

[45] Nov. 10, 1981

[54] AC REGULATOR SYSTEM FOR QUARTZ IODINE LAMPS

[75] Inventors: Ralph G. Foose, Aurora; John D. Crabtree, Cuyahoga Falls, both of Ohio

[73] Assignee: The Nuarc Company, Inc., Chicago, Ill.

[21] Appl. No.: 138,922

[22] Filed: Apr. 10, 1980

[51] Int. Cl.[3] ..... H05B 39/08

[52] U.S. Cl. ..... 315/307; 315/199; 315/208; 315/311

[58] Field of Search ..... 315/208, 194, 199, 307, 315/311; 355/69

[56] References Cited

U.S. PATENT DOCUMENTS

| | | | |
|---|---|---|---|
| 3,670,202 | 6/1972 | Paine et al. | 315/311 X |
| 4,039,897 | 8/1977 | Dragoset | 315/208 X |
| 4,155,032 | 5/1979 | Schlick et al. | 315/307 |

FOREIGN PATENT DOCUMENTS

| | | | |
|---|---|---|---|
| 2647266 | 4/1978 | Fed. Rep. of Germany | 315/307 |

*Primary Examiner*—Eugene R. La Roche

*Attorney, Agent, or Firm*—Mason, Kolehmainen, Rathburn & Wyss

[57] ABSTRACT

A bank of high power quartz iodine lamps is regulated so that changes in light output from the lamps for a 40 volt change in AC line voltage is reduced from 132% to 10%. To accomplish this, a regulating pulse width modulator is synchronized to the AC line so that pulse width modulated pulses are developed the trailing edge of which is coincident with the zero crossover points of the AC line voltage. The variable leading edge of these width modulated pulses is employed to control the firing point of semiconductor switching devices in series with the lamps, the average voltage across the lamps being sensed and employed by the regulating pulse width modulator to vary the width of the pulses in the correct direction to maintain the lamp voltage constant despite large changes in line voltage.

14 Claims, 1 Drawing Figure

AC REGULATOR SYSTEM FOR QUARTZ IODINE LAMPS

Figure 1:
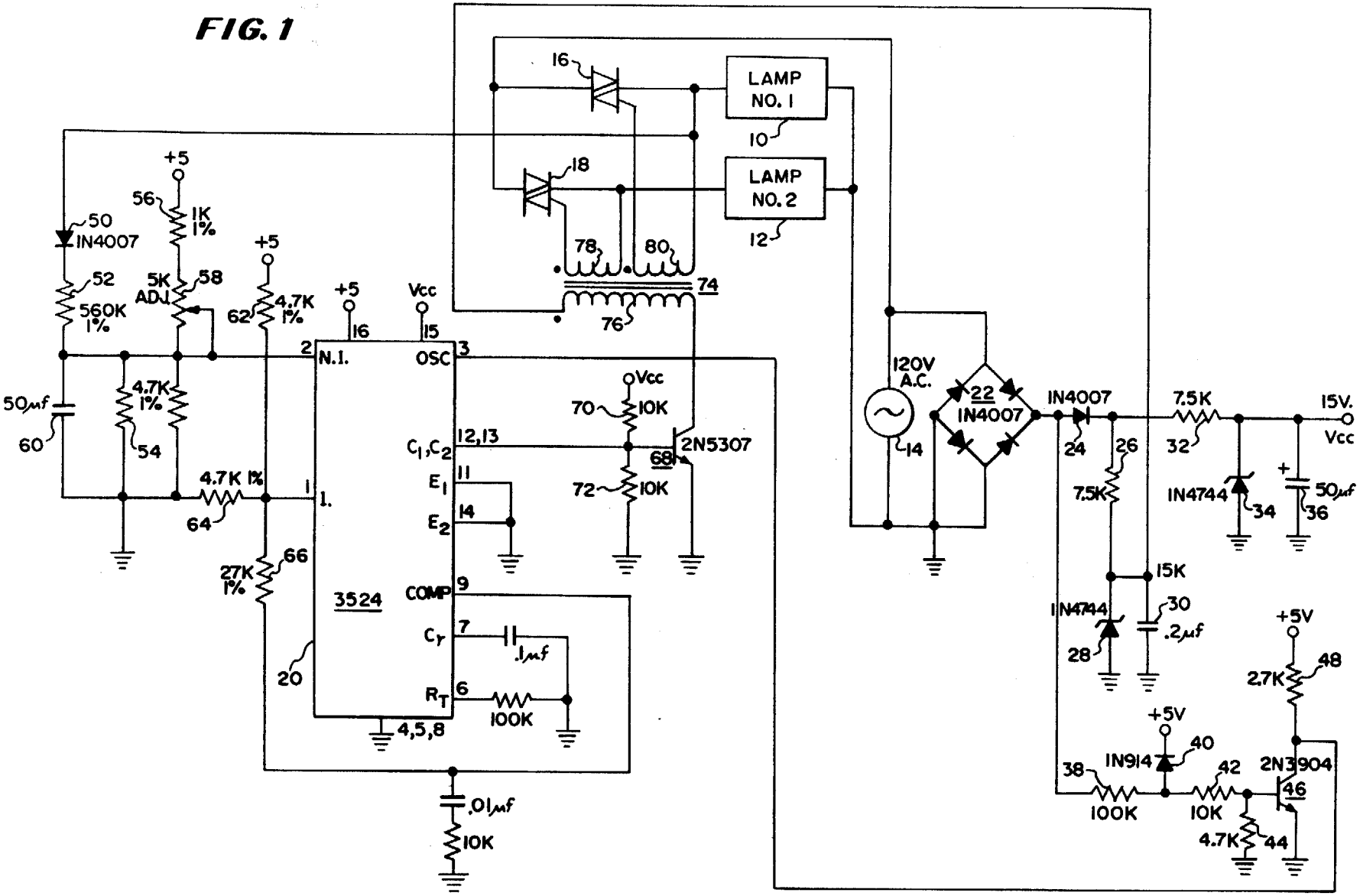

The present invention relates to AC line regulator systems, and, more particularly, to AC line regulators of the so-called phase fired type wherein the phase angle at which the firing of a semiconductor switching device is varied to provide the desired regulation in an associated load circuit. The regulation system of the present invention is particularly suitable for and will be described in connection with the regulation of quartz iodine lamps of the type used in cameras employed in the graphics arts industry.

The cameras used in the graphic arts industry, while similar in function to conventional cameras, usually employ film which is significantly larger. For example cameras employed in the graphic arts industry may have a film size as large as (30″×30″). The film in such cameras is exposed by a shutter mechanism which allows the light reflected from the image to reach the film. The exposure time can be as great as 30–45 seconds, depending on the type of film, the light intensity, and the effect desired. The typical light source for cameras of this type is a group of quartz iodine lamps. Each lamp may have a wattage of up to 800–900 watts and there can be eight lamps in one camera system. Accordingly, a bank of quartz iodine lamps in a typical camera may require a total power of 6800 watts.

Since the exposure time is directly related to the light energy (photons) striking the film, variations in light output will cause variations in the exposure time required. Furthermore, in quartz iodine lamps the light output of the lamp is exponentially related to the RMS value of the lamp excitation voltage, the exact value of the exponent being a function of the particular lamp design. For example, in a typical design a five percent variation in lamp voltage can produce a thirteen percent change in light output. Accordingly, it would be desirable to provide a highly regulated line voltage source so that the light output would be substantially constant and exposure times would be uniform despite large fluctuations in the AC line voltage.

One conventional arrangement for regulating an AC line is by the use of a ferro resonant transformer. However, if such an arrangement were employed to control the 6800 watt load of a bank of quartz iodine camera lamps, the ferro resonant transformer would be extremely expensive and would not be commercially attractive from a cost standpoint.

While various arrangements have been proposed for varying the AC line voltage applied to a lamp by varying the phase angle at which a semiconductor switching device is fired, as for example in projector equipment for selecting the intensity level of the lamp, if the lamp is to be regulated at rated line voltage then a transformer arrangement must be employed to permit variation above and below line voltage. Such a transformer arrangement when regulating a load of 6800 watts for a bank of camera lamps would also be prohibitively expensive.

It is, therefore, an object of the present invention to provide a new and improved AC line regulation system which is particularly suitable for controlling a bank of quartz iodine lamps and wherein one or more of the above discussed disadvantages of prior art arrangements is avoided.

It is another object of the present invention to provide an AC line regulation system for high wattage loads wherein the firing point of a semiconductor switching device is varied to provide the necessary regulation without requiring a transformer in the main current path of the load circuit.

A further object of the present invention is to provide a new and improved AC line regulation systems for a bank of quartz iodine lamps wherein the firing point of a semiconductor switching means is referenced to a point at which the voltage across the lamp bank is substantially reduced from the AC line voltage and the lamps are designed to have rated light output at said reduced voltage.

It is another object of the present invention to provide a new and improved system for controlling the AC voltage applied to a bank of quartz iodine lamps wherein a regulating pulse width modulator is synchronized with the AC line voltage and provides variable width output pulses which are employed to control the firing point of a semiconductor switching means in series with the lamp bank.

Briefly, in accordance with one aspect of the invention, the quartz iodine lamps which are to be regulated are designed to provide rated power output at a reduced voltage substantially below rated line voltage. For example, with a nominal line voltage of 120 volts rms the quartz iodine lamps of the present invention are designed to provide rated power output at a voltage of 80 volts rms. The lamp is connected to the AC line through a semiconductor switching device and a control signal proportional to the average voltage across the lamp is employed to vary the firing point of said semiconductor switching device so that the average voltage across the lamp is maintained substantially constant despite large fluctuations in said line voltage. The reference point of the regulator system is selected so that the voltage applied to the lamp when the AC line voltage has said rated value is the reduced voltage at which the lamp is designed to provide rated light output.

In a preferred embodiment, the control signal is compared with a regulated reference voltage in the operational amplifier input stage of a regulating pulse width modulator type of integrated circuit. The normally free running oscillator section of the pulse width modulator is synchronized with the AC line by developing synchronizing pulses corresponding to the zero crossover points of the AC line voltage. These synchronizing pulses, which occur at a rate of 120 pulses per second, are then used to control the timing of the trailing edge of the variable width pulses developed within the modulator. The op amp error voltage is employed to control the timing of the leading edge of the variable width pulse so that variations in said error voltage cause the firing point of the semiconductor switching device to change in the correct direction to maintain the voltage across the lamp substantially constant despite large fluctuations in the AC line voltage.

The invention, both as to its organization and method of operation, together with further objects and advantages thereof, will best be understood by reference to the following specification taken in connection with the accompanying drawings, in which:

The single FIGURE of the drawings is a schematic diagram of the AC line regulator system of the present invention.

Referring now to the drawings, in the arrangement of the present invention a bank of quartz iodine lamps, such as the illustrated lamps 10, 12 is arranged to be energized from the AC line 14 under the control of the series connected semiconductor Triac type switching devices 16, 18.

In order to provide a suitable gating control signal for the gating electrodes of the Triacs 16, 17 a regulating pulse width modulator 20 is employed, which may be of the commercial type 3524 and is available from a number of integrated circuit manufacturers such as Silicon General and Texas Instruments, Inc. Regulating pulse width modulators of this type have heretofore been used only in DC switching regulators wherein the pulse width modulated output is normally stepped up or down in an output transformer circuit and is then rectified and utilized as a DC control voltage.

Power for the modulator 20 is derived from the AC line 14 through a suitable stabilized supply circuit. More particularly, the AC line voltage is rectified in the bridge rectifier 22 and is supplied through a diode 24 and resistor 32 to a Zener diode 34, a capacitor 36 being connected across the Zener diode so that a +15 volt stabilized DC voltage, identified as $V_{cc}$, is available for energizing the pulse width modulator 20.

The voltage across one of the lamps, such as the lamp 10, is sensed by a diode 50 which is connected in series with a resistor 52 and filter capacitor 60 to the ground terminal to which the lamps 10, 12 are also connected. There is thus produced across the capacitor 60 a voltage which is proportional to the average voltage developed across the lamp 10. The inverting input of the operational amplifier input stage of the pulse width modulator 20 is biased by means of the resistors 62 and 64 which are connected between a +5 volt source (which is an internal regulated dc voltage supply within the modulator 20) and ground, a feedback resistor 66 being connected from the output of this operational amplifier stage to the inverting input at which the +2.5 volt reference potential is established. A current balancing network is provided for the diode sensing input, this network comprising the resistor 56, the potentiometer 58 and the parallel connected resistors 54 which are connected between the +5 volt DC supply and ground, the potentiometer 58 being adjusted so that the firing point of the Triacs 16, 18 will be at the desired phase angle relative to the zero crossover points of the AC line voltage. The sensed average voltage across the lamp 10 is amplified in the operational amplifier input stage of the modulator 20 and is employed to control the width of the modulator pulses developed therein.

In accordance with an important aspect of the present invention the oscillator portion of the pulse width modulator 20, which is normally operated as a free running oscillator, is synchronized to the zero crossover points of the AC line voltage 14 so that a width modulated pulse the trailing edge of which is coincident with each of the crossover points of the AC line is developed. More particularly, a bridge rectifier 22 is employed to develop a full wave rectified voltage which is supplied through the resistors 38 and 42 to the base of the transistor 46. A clamping diode 40 is connected between the junction point of the resistors 38 and 42 and the +5 volt supply, the base electrode of the transistor 46 being connected through the resistor 44 to ground. With this arrangement, synchronizing pulses which occur at a 120 Hz rate are developed across the collector resistor 48 and are supplied to the input terminal 3 of the pulse width modulator 20. This terminal is connected to the internal oscillator of the modulator and the synchronizing pulses are of the proper polarity to synchronize this oscillator so that it operates at a 120 Hz rate and in synchronism with the AC line which is being used to energize the lamps 10, 12.

The leading edge of the width modulated pulse which is developed by the modulator 20 is controlled in accordance with variations in the error voltage developed in response to the sensed lamp voltage. In accordance with an important aspect of the present invention the position of this leading edge when the line voltage 14 has rated value, is chosen so as to permit a substantial variation in the position of this leading edge to accommodate wide fluctuations in the AC line voltage 14. This means that under normal rated line voltage the firing point of the Triacs, 16, 18 will occur at a substantial phase angle from the initial crossover point of the line voltage wave, for example, at a phase angle of 85 degrees, so that a substantially non-sinusoidal wave which has an average value substantially less than the rated line voltage is applied to the lamps 10, 12.

In accordance with a further aspect of the invention, the lamps 10, 12 are designed so that they produce their rated light output when this reduced non-sinusoidal voltage is supplied by the regulator. In this connection it will be understood that certain types of lamps, such as mercury arc lamps, cannot be controlled in the manner of the present invention because they require a substantially sinusoidal input voltage in order to remain in the conductive state and produce the desired light output characteristics. However, quartz iodine lamps are capable of giving the desired light output characteristics with an applied voltage of substantially unsymmetrical wave form so that this type of lamp can operate with the firing point on the Triacs at a substantial distance from the initial zero crossover point and thereby permit substantial variation of the firing point to accommodate fluctuations in the AC line voltage and without requiring the use of any transformer in the lamp current circuit. Accordingly, the regulator system of the present invention may be employed to regulate a bank of eight quartz iodine lamps which require a power of approximately 6,800 watts without requiring the use of any transformers and while operating from nominal line voltages. For example, the lamps 10, 12 may be designed to provide their rated light output power when a non-sinusoidal eighty volt rms wave form is supplied by the pulse width modulator with a nominal 120 volt AC line 14. In the event a 220 volt line is employed, the lamps 10, 12 are designed to provide rated light output when a non-sinusoidal voltage of approximately 170 volts is supplied thereto. Furthermore, with the voltage regulator arrangement of the present invention, wide fluctuations in the AC line voltage may be accommodated while providing very small changes in the light output of the quartz iodine lamps. For example, for a 40 volt input change in the AC line 14, a four volt output change is developed across the lamps 10, 12 so that the light output change caused by a 40 volt line input change is reduced from 132% to 10%.

The width modulator pulses thus developed by the pulse modulator 20 are supplied from the output terminals 12, 13 thereof to the base of a driver transistor 68, which may be of the commercial type 2N5307, the base of this transistor being biased by means of the voltage divider network 70, 72 which is connected between the regulated 15 volt supply developed across the capacitor 36 and ground.

In accordance with a further aspect of the present invention a separate stabilized dc voltage is provided for the collector of the transistor 68 so that the sharp pulses of current drawn by this transistor when it is conducting will not cause interference with other portions of the circuit. More particularly, the resistor 26 and Zener diode 28 are connected from the junction point of the diode 24 and resistor 32 to ground and a filter capacitor 30 is connected across this Zener diode to provide a 15 volt stabilized dc supply which is connected to one end of the primary winding 76 of a pulse transformer the other end of this winding being connected to the collector of the transistor 68. A pair of transformer windings 78, 80 are provided to control the gate electrodes of the Triac 16 and 18. It will be understood that the current requirements of the pulse transformer 74 and driver transistor 68 on the pulse modulator 20 are relatively small since the gating signals supplied to the gating electrodes of the Triacs 16, 18 are at a relatively low power level although these Triacs may be employed to control a relatively high wattage lamp load. Preferably, each Triac 16, 18 may control two 800 watt lamps so that a total of four lamps may be controlled by the pulse transformer 74 and Triacs 16, 18. When an additional four lamps are to be controlled, a separate driver transistor and pulse transformer may be provided, this driver transistor being controlled from the output terminals 12, 13 of the modulator 20 in a manner similar to that shown.

While there has been illustrated and described a preferred embodiment of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent of the United States is:

1. An alternating current line voltage regulation system comprising, a source of AC line voltage having a nominal value and subject to fluctuations in amplitude of substantial magnitude, a quartz iodine lamp capable of providing a rated power output at a reduced voltage substantially below said nominal value of said AC source, semiconductor switching means, means connecting said lamp and said switching means directly in series across said AC source, means for developing a control signal proportional to the average voltage across said lamp, and means controlled by said control voltage for varying the firing point of said semiconductor switching means relative to a predetermined reference voltage point so that the average voltage across said lamp is maintained substantially constant despite said line voltage fluctuations, said reference voltage point being selected so that a non-sinusoidal voltage having an average value equal to said reduced lamp voltage is applied to said lamp when said alternating current source has said nominal value.

2. The combination of claim 1, wherein said reduced lamp voltage is approximately 80 volts and said line voltage has a nominal value of 120 volts.

3. The combination of claim 1, wherein said reduced lamp voltage is approximately 170 volts and said line voltage has a nominal value of 220 volts.

4. The combination of claim 1, which includes pulse width modulator means controlled by said control voltage for varying the firing point of said semiconductor switching means.

5. The combination of claim 4, wherein said pulse width modulator includes a normally free running oscillator, and means for synchronizing said oscillator with said source of AC line voltage.

6. The combination of claim 5 wherein said synchronizing means includes full wave rectifier means connected to said source of AC line voltage, and means including clamping diode means conncted to the outpt of said full wave rectifier means for developing synchronizing pulses corresponding to the zero crossover points of said AC line voltage.

7. The combination of claim 6, which includes first DC voltage regulator means connected to the output of said full wave rectifier means for developing a first stabilized DC voltage, means for supplying said first DC voltage to said pulse width modulator as a power source therefor, a second DC voltage regulator energized by said first stabilized DC voltage for developing a second regulated DC voltage of lower value, and means for energizing said clampingg diode means from said second regulated DC voltage.

8. The combination of claim 4, wherein said control signal developing means includes a diode connected to the junction of said lamp and said semiconductor switching means, and means including said diode for developing a DC control signal having an average value equal to the AC voltage across said lamp.

9. The combination of claim 8, which includes means for developing a DC reference signal, and means for comparing said DC control signal with said DC reference signal and developing an error signal proportional to the difference therebetween.

10. The combination of claim 9, which includes means for controlling said pulse width modulator means in accordance with variations in said error signal, thereby to maintain the voltage across said lamp at a value determined by said DC reference signal.

11. The combination of claimn 10, which includes means for varying said DC reference signal.

12. The combination of claim 4, wherein said pulse width modulator means develops variable width pulses in synchronism with said AC line voltage, a pulse transformer having a secondary winding connected to the gate control element of said semiconductor switching means, and means controlled by said variable width pulses for supplying pulses to the primary of said pulse transformer, whereby the firing point of said semiconductor switching means is varied in accordance with said variable width pulses.

13. The combination of claim 12, which includes a transistor having a collector connected to said primary of said pulse transformer, and means for supplying pulses corresponding to said variable width pulses to the base of said transistor.

14. The combination of claim 12, which includes means connected to said AC source for developing a first stabilized DC voltage, means for connecting said first stabilized DC voltage to the collector of said transistor through said pulse transformer primary, means connected to said AC source for developing a second stabilized DC voltage, and means for connecting said second DC voltage to the base of said transistor.

* * * * *